US011475827B2

(12) United States Patent
Tsai et al.

(10) Patent No.: US 11,475,827 B2
(45) Date of Patent: Oct. 18, 2022

(54) ELECTRONIC DEVICE FOR REDUCING POWER CONSUMPTION

(71) Applicant: Innolux Corporation, Miao-Li County (TW)

(72) Inventors: Chia-Hao Tsai, Miao-Li County (TW); Yi-Shiuan Cherng, Miao-Li County (TW); Syuan-Ruei Siao, Miao-Li County (TW); Chien-Feng Shih, Miao-Li County (TW); Sheng-Feng Huang, Miao-Li County (TW)

(73) Assignee: Innolux Corporation, Miao-Li County (TW)

( * ) Notice: Subject to any disclaimer, the term of this patent is extended or adjusted under 35 U.S.C. 154(b) by 0 days.

(21) Appl. No.: 17/142,238

(22) Filed: Jan. 6, 2021

(65) Prior Publication Data

US 2021/0225257 A1 Jul. 22, 2021

Related U.S. Application Data

(60) Provisional application No. 62/964,118, filed on Jan. 22, 2020.

(30) Foreign Application Priority Data

Oct. 21, 2020 (CN) ..... 202011133112.6

(51) Int. Cl.
*G09G 5/00* (2006.01)
*G09G 3/20* (2006.01)

(52) U.S. Cl.
CPC ..... *G09G 3/2092* (2013.01); *G09G 3/2003* (2013.01); *G09G 3/2014* (2013.01);
(Continued)

(58) Field of Classification Search
CPC .. G09G 3/2003; G09G 3/2014; G09G 3/2092; G09G 3/2074; G09G 2310/0235;
(Continued)

(56) References Cited

U.S. PATENT DOCUMENTS

2006/0146112 A1* 7/2006 Kim ..... G09G 3/3677 347/149
2008/0136964 A1* 6/2008 Yamazaki ..... G09G 3/3677 348/450

(Continued)

FOREIGN PATENT DOCUMENTS

CN 104103321 10/2014
CN 104299583 1/2015

(Continued)

OTHER PUBLICATIONS

"Office Action of China Counterpart Application", dated Apr. 6, 2022, p. 1-p. 9.

*Primary Examiner* — Adam J Snyder
(74) *Attorney, Agent, or Firm* — JCIPRNET

(57) ABSTRACT

The disclosure provides an electronic device. The electronic device includes a pixel array and a first driving circuit. The pixel array is disposed on a substrate and includes a plurality of sub-pixel rows. The first driving circuit is disposed on the substrate and located on one side of the pixel array. The first driving circuit includes a plurality of demultiplexer circuits and a plurality of switching circuits. The demultiplexer circuits include a first demultiplexer circuit. The switching circuits include a first switching circuit. The first switching circuit is coupled to the first demultiplexer circuit, and the first demultiplexer circuit is coupled to at least three of the plurality of sub-pixel rows.

17 Claims, 9 Drawing Sheets

(52) U.S. Cl.
CPC ... *G09G 3/2074* (2013.01); *G09G 2310/0235* (2013.01); *G09G 2310/0267* (2013.01); *G09G 2310/0286* (2013.01); *G09G 2310/0297* (2013.01); *G09G 2310/08* (2013.01); *G09G 2330/021* (2013.01)

(58) Field of Classification Search
CPC ... G09G 2310/0267; G09G 2310/0286; G09G 2310/0297; G09G 2310/08; G09G 2330/021
See application file for complete search history.

(56) References Cited

U.S. PATENT DOCUMENTS

| | | | | |
|---|---|---|---|---|
| 2012/0133392 | A1* | 5/2012 | Wang | G09G 3/3677 326/83 |
| 2013/0187837 | A1* | 7/2013 | Yokoyama | G09G 3/3674 345/55 |
| 2014/0300399 | A1* | 10/2014 | Miyake | G09G 3/3677 327/296 |
| 2016/0148556 | A1* | 5/2016 | Tseng | G09G 3/3677 345/55 |
| 2016/0189683 | A1* | 6/2016 | Chen | G09G 3/3677 345/213 |
| 2017/0270882 | A1* | 9/2017 | Mori | G09G 3/3677 |
| 2019/0392915 | A1* | 12/2019 | Zhu | G09G 3/3674 |
| 2020/0194089 | A1* | 6/2020 | Xu | G09G 3/3648 |

FOREIGN PATENT DOCUMENTS

| | | |
|---|---|---|
| CN | 105096874 | 11/2015 |
| CN | 110299116 | 10/2019 |

* cited by examiner

ELECTRONIC DEVICE FOR REDUCING POWER CONSUMPTION

CROSS-REFERENCE TO RELATED APPLICATION

This application claims the priority benefit of U.S. provisional application No. 62/964,118, filed on Jan. 22, 2020, and China application no. 202011133112.6, filed on Oct. 21, 2020. The entirety of each of the above-mentioned patent applications is hereby incorporated by reference herein and made a part of this specification.

TECHNICAL FIELD

The disclosure relates to an electronic device, and more particularly, to an electronic device that may reduce power consumption.

BACKGROUND

During the process of displaying images by a display panel which adopts the one-data-triple-gate (ODTG) architecture, because a signal waveform of a data signal needs to be continuously converted to correspond to a signal waveform of a different color pixel, circuits generating the data signal will generate more power consumption due to the excessive number of times the signal waveform is switched.

SUMMARY

Accordingly, the disclosure proposes a circuit design of an electronic device that may reduce power consumption.

According to an embodiment of the disclosure, the electronic device of the disclosure includes a pixel array and a first driving circuit. The pixel array is disposed on a substrate and includes a plurality of sub-pixel rows. The first driving circuit is disposed on the substrate and located on one side of the pixel array. The first driving circuit includes a plurality of demultiplexer circuits and a plurality of switching circuits. The demultiplexer circuits include a first demultiplexer circuit. The switching circuits include a first switching circuit. The first switching circuit is coupled to the first demultiplexer circuit, and the first demultiplexer circuit is coupled to at least three of the plurality of sub-pixel rows.

To make the aforementioned more comprehensible, several embodiments accompanied with drawings are described in detail as follows.

DETAILED DESCRIPTION

Figure 1:
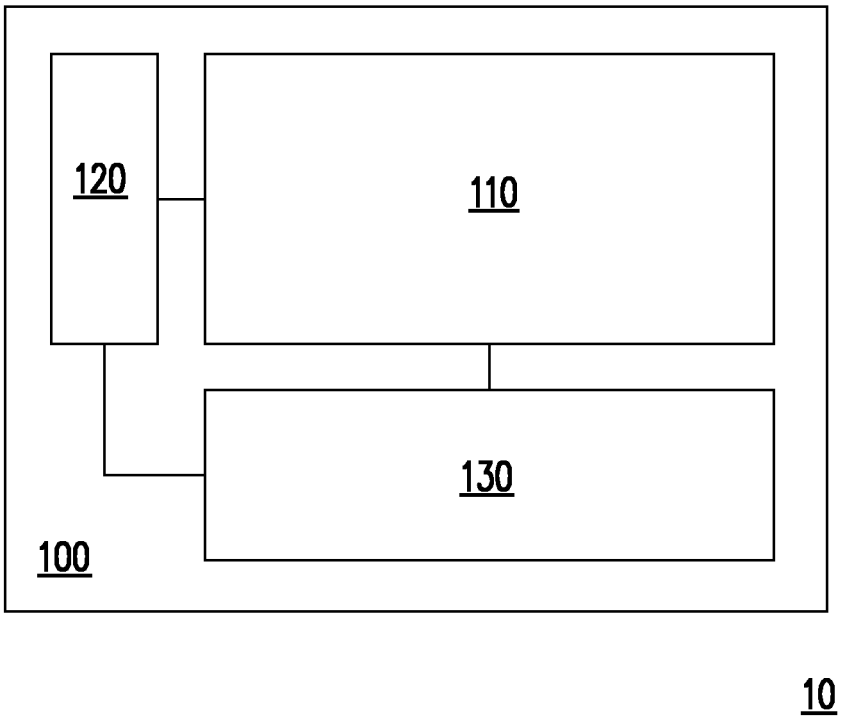
FIG. 1 is a schematic view of an electronic device according to an embodiment of the disclosure.

Reference will now be made in detail to the exemplary embodiments of the disclosure, examples of which are illustrated in the accompanying drawings. Wherever possible, the same reference numbers are used in the drawings and the description to refer to the same or like parts.

Some words are used to refer to specific elements in the whole specification and the appended claims in the disclosure. A person skilled in the art should understand that an electronic device manufacturer may use different names to refer to the same elements. The specification is not intended to distinguish elements that have the same functions but different names. In the following specification and claims, the terms "having", "including", etc. are open-ended terms, so they should be interpreted to mean "including but not limited to . . . ".

The directional terms mentioned herein, like "above", "below", "front", "back", "left", and "right", refer to the directions in the accompanying drawings. Therefore, the directional terms are used for illustration instead of limiting the disclosure. In the accompanying drawings, common features of a method, a structure and/or a material used in a specific embodiment are shown in the drawings. However, these drawings should not be construed as defining or limiting the scope or nature of these embodiments. For example, the relative sizes, thicknesses and positions of films, regions and/or structures may be reduced or enlarged for clarity.

When a corresponding component (e.g., a film or a region) is referred to as being "on another component", it may be directly on the another component, or there may be other components between the two components. In another aspect, when a component is referred to as being "directly on another component", there is no component between the two components. In addition, when a component is referred to as being "on another component", the two components have an up and down relationship in a top view. The component may be located above or below the another component, and the up and down relationship depends on the orientation of the device.

In some embodiments of the disclosure, unless specifically defined, terms related to bonding and connection such as "connect", "interconnect", etc. may mean that two structures are in direct contact, or that two structures are not in direct contact with other structures provided therebetween. The terms related to bonding and connection may also cover cases where two structures are both movable or two structures are both fixed. In addition, the term "couple" includes any direct and indirect electrical connection means.

Ordinal numbers used in the specification and the claims, like "first" and "second", are used to modify the elements, and do not imply or represent that the (or these) element(s) has (or have) any ordinal number, and do not indicate any order between an element and another element, or an order in a manufacturing method. These ordinal numbers are merely used to clearly distinguish an element having a name with another element having the same name. Different terms may be used in the claims and the specification, so that a first component in the specification may be a second component in the claims.

In the disclosure, the electronic device may include a display device, an antenna device, a sensing device, a touch electronic device, a curved electronic device, or a free shape electronic device, but is not limited thereto. The electronic device may be a bendable or flexible electronic device. The electronic device may include, for example, a liquid crystal, a light emitting diode, a quantum dot (QD), a fluorescence, a phosphor, other suitable display media, or a combination of the above, but is not limited thereto. The light emitting diode may include, for example, an organic light emitting diode (OLED), a mini LED, a micro LED or a quantum dot LED (e.g., QLED or QDLED), other suitable materials that can be arranged and combined arbitrarily, but is not limited thereto. The display device may include, for example, a tiled display device, but is not limited thereto. The antenna device may be, for example, a liquid crystal antenna, but is not limited thereto. The antenna device may include, for example, an antenna tiled device, but is not limited thereto. It is noted that the electronic device may be any combination of the above, but is not limited thereto. In addition, the shape of the electronic device may be rectangular, circular, polygonal, a shape with curved edges, or other suitable shapes. The electronic device may have peripheral systems such as a driving system, a control system, a light source system, etc. to support a display device, an antenna device, or a tiled device. Hereinafter, a display device will be described to illustrate the content of the disclosure, but the disclosure is not limited thereto.

It should be noted that in the following embodiments, features in a plurality of embodiments may be replaced, recombined, or mixed to complete other embodiments without departing from the spirit of the disclosure. The features of the embodiments may be used in any combination without departing from the spirit of the disclosure or conflicting with each other.

FIG. 1 is a schematic view of an electronic device according to an embodiment of the disclosure. Referring to FIG. 1, an electronic device 10 includes a substrate 100. The substrate 100 may include a rigid substrate, a flexible substrate, or a combination thereof. The material of the substrate 100 may include glass, quartz, sapphire, ceramic, polycarbonate (PC), polyimide (PI), polypropylene (PP) polyethylene terephthalate (PET), other suitable materials, or a combination of the above, but not limited thereto. The substrate 100 may adopt the GOA (Gate on Array) design so that a pixel array 110, a driving circuit 120 and a package circuit 130 can be formed on the substrate 100. The package circuit 130 may include, for example, a fan out circuit, a bonding circuit, and/or an integrated circuit, but the disclosure is not limited thereto. In this embodiment, the pixel array 110 may correspond to an active area (AA) of a panel, and the driving circuit 120 and the package circuit 130 may correspond to a peripheral area (an area outside the active area) of the panel. In this embodiment, the driving circuit 120 is coupled to the pixel array 110 and the package circuit 130, and the pixel array 110 is coupled to the package circuit 130. The driving circuit 120 can be coupled to a plurality of sub-pixel rows of the pixel array 110 through a plurality of gate lines, and the package circuit 130 can be coupled to multiple columns of pixels of the pixel array 110 through a plurality of data lines. It should be noted that, sub-pixels (e.g., including red sub-pixels, green sub-pixels, and blue sub-pixels) of the pixels of the pixel array 110 of this embodiment are arranged based on the one-data-triple-gate (ODTG) architecture. In some other embodiments, the pixels may further include sub-pixels of other colors, and the disclosure is not limited thereto.

Figure 2:
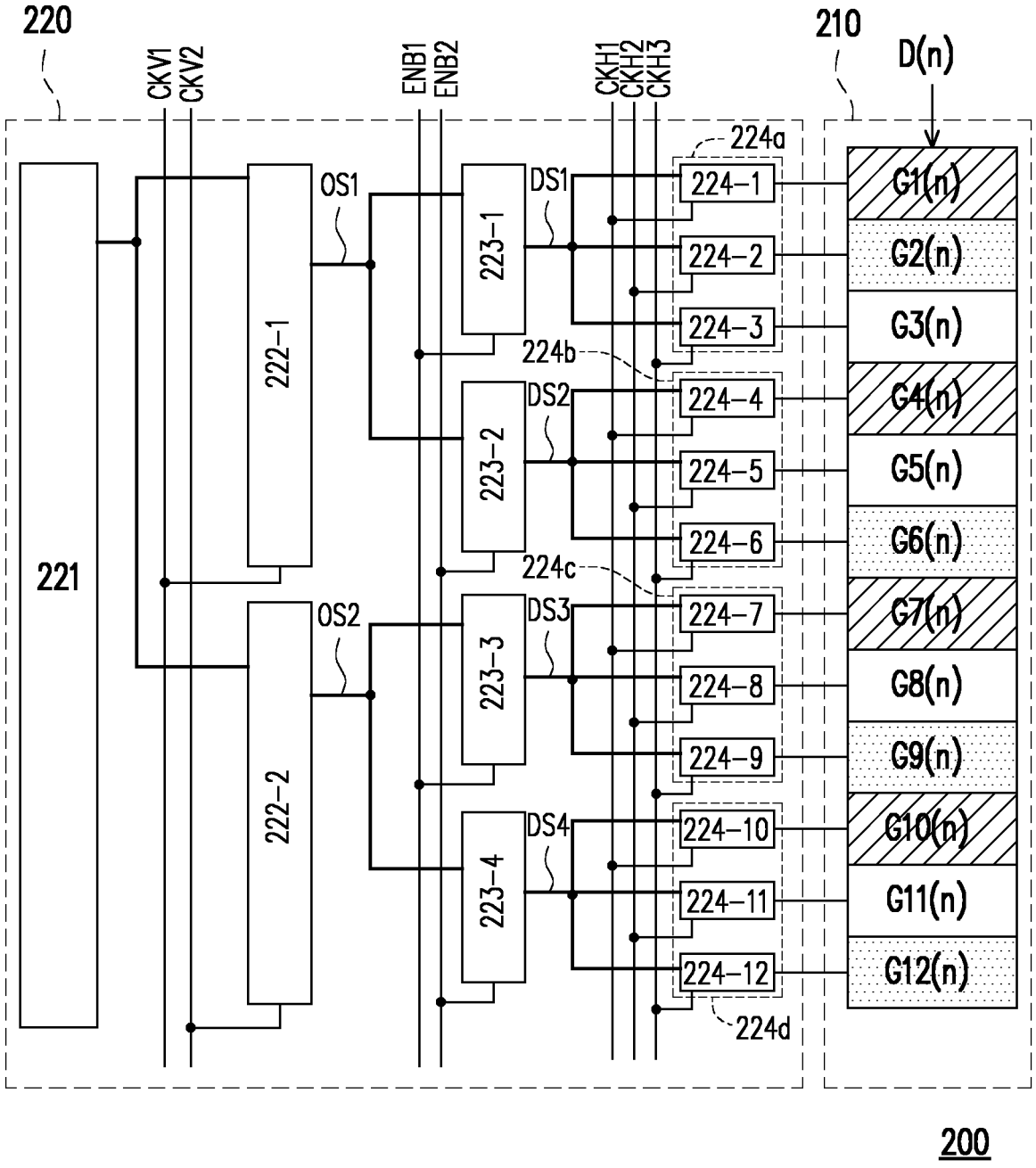
FIG. 2 is a schematic diagram of a driving circuit on one side according an embodiment of the disclosure.

FIG. 2 is a schematic diagram of a driving circuit on one side according an embodiment of the disclosure. Referring to FIG. 2, a pixel array 210 of an electronic device 200 can include a plurality of sub-pixel rows G1(*n*) to G12(*n*), where n is the number of columns, and is a positive integer greater than or equal to 1. In detail, there may be multiple columns of sub-pixels in the embodiment of the disclosure, and the number of columns may be adjusted according to actual design requirements. One column of sub-pixels is exemplarily illustrated in FIG. 2, but the disclosure is not limited thereto. One column of sub-pixels is also exemplarily illustrated in other embodiments below, which is repeated hereinafter. The sub-pixel rows G1(*n*) to G12(*n*) may also correspond to the first to the twelfth gate lines of the pixel array 210. It should be noted that, the number of rows of the pixel array 210 of this embodiment is not limited to the number shown in FIG. 2, and there may be more sub-pixel rows. In this embodiment, each three rows of the sub-pixel rows G1(*n*) to G12(*n*) (e.g., the three sub-pixel rows G1(*n*) to G3(*n*)) may be a red sub-pixel row, a green sub-pixel row and a blue sub-pixel row in sequence, and/or the three sub-pixel rows G4(*n*) to G6(*n*) may be the red sub-pixel row, the green sub-pixel rows and the blue sub-pixel row in sequence. Each column of the three sub-pixel rows G1(*n*) to G3(*n*) may constitute one pixel (e.g., sub-pixels G1(1) to G3(1)). However, the color type and arrangement of the sub-pixels in the disclosure are not limited thereto. In some other embodiments, each four rows of the sub-pixel rows G1(*n*) to G12(*n*) (e.g., the four sub-pixel rows G1(*n*) to G4(*n*)) may be a sub-pixel row of a first color, a sub-pixel row of a second color, a sub-pixel row of a third color and a sub-pixel row of a fourth color in sequence, and/or the four sub-pixel rows G5(*n*) to G8(*n*)) may be the sub-pixel row of the first color, the sub-pixel row of the second color, the sub-pixel row of the third color and the sub-pixel row of the fourth color in sequence. The first color, the second color, the third color and the fourth color may be different from each other. That is, each column of the four sub-pixel rows G1(*n*) to G4(*n*) may constitute one pixel (e.g., sub-pixels G1(1) to G4(1)), but the disclosure is not limited thereto. In this embodiment, each column of the sub-pixel rows G1(*n*) to G12(*n*) can receive a corresponding data signal D(n). Here, n may be identical to n described above (e.g., the positive integer greater than or equal to 1). The data signal D(n) may be provided by, for example, the package circuit 130 of FIG. 1.

In this embodiment, a driving circuit 220 of the electronic device 200 of FIG. 2 may include a shift register 221, an output circuit 222-1, an output circuit 222-2, switching circuits 223-1 to 223-4 and demultiplexer circuits 224*a* to 224*d*. Here, the driving circuit 220 may be disposed at a position of the driving circuit 120 of FIG. 1 (located on one side of the pixel array 110). Each of the demultiplexer circuits 224*a* to 224*d* includes three switching elements, and switching elements 223-1 to 223-4 are respectively coupled to the sub-pixel rows G1(*n*) to G12(*n*) of the pixel array 210. In this embodiment, each of the switching elements 223-1 to 223-4 may be one diode, but the disclosure is not limited thereto. In this embodiment, the switching elements 223-1 to 223-4 are respectively coupled to the demultiplexer circuits 224*a* to 224*d*, and the switching circuits 223-1 to 223-4 respectively provide driving signals DS1 to DS4 to each corresponding three of the switching elements 224-1 to 224-12. Specifically, the switching circuit 223-1 is coupled to the demultiplexer circuit 224*a*, and the demultiplexer circuit 224*a* is coupled to the switching elements 224-1 to 224-3. The switching circuit 223-2 is coupled to the demultiplexer circuit 224*b*, and the demultiplexer circuit 224*b* is coupled to the switching elements 224-4 to 224-6. The switching circuit 223-3 is coupled to the demultiplexer circuit 224*c*, and the demultiplexer circuit 224*c* is coupled to the switching elements 224-7 to 224-9. The switching circuit 223-4 is coupled to the demultiplexer circuit 224*d*, and the demultiplexer circuit 224*d* is coupled to the switching elements 224-10 to 224-12. In this embodiment, the demultiplexer circuit 224*a* can be coupled to three sub-pixel rows G1(*n*) to G3(*n*). In detail, the switch elements 224-1 to 224-3 are respectively coupled to the three sub-pixel rows G1(*n*) to G3(*n*). Each column of the three sub-pixel rows G1(*n*) to G3(*n*) may constitute one pixel. That is, the number of switch elements included in each of the demultiplexer circuits 224*a* to 224*d* may correspond to the number of sub-pixels included in one pixel. Nonetheless, in some other embodiments, the demultiplexer circuit 224*a* may be coupled to more than three sub-pixel rows (e.g., coupled to the four sub-pixel rows G1(*n*) to G4(*n*)) In detail, the switch elements 224-1 to 224-4 are respectively coupled to the four sub-pixel rows G1(*n*) to G4(*n*). Each column of the four sub-pixel rows G1(*n*) to G4(*n*) described above may constitute one pixel, but the disclosure is not limited thereto.

In this embodiment, the shift register 221 is coupled to the output circuit 222-1 and the output circuit 222-2. The output circuit 222-1 and the output circuit 222-2 are coupled to the switching circuits 223-1 to 223-4, and the output circuit 222-1 and the output circuit 222-2 are respectively coupled to each two of the switching circuits 223-1 to 223-4. Specifically, the output circuit 222-1 is coupled to the switching circuit 223-1 and the switching circuit 223-2, and the output circuit 222-2 is coupled to the switching circuit 223-3 and the switching circuit 223-4. It should be noted that, the numbers of the output circuits, the switching circuits and the demultiplexer circuits in this embodiment may be determined according to the number of the sub-pixel rows of the pixel array 210 rather than being limited what illustrated in FIG. 2. For instance, in some embodiments, the shift register 221 may be coupled to more than two output circuits. The output circuit 222-1 or the output circuit 222-2 may be coupled to more than two switching circuits, and each of the switching circuits 223-1 to 223-4 may be coupled to more than three demultiplexer circuits. The disclosure is not limited to the above. In this embodiment, the driving circuit 220 of FIG. 2 can represent a schematic diagram of a part of the driving circuit 120 of FIG. 1.

Figure 3A:
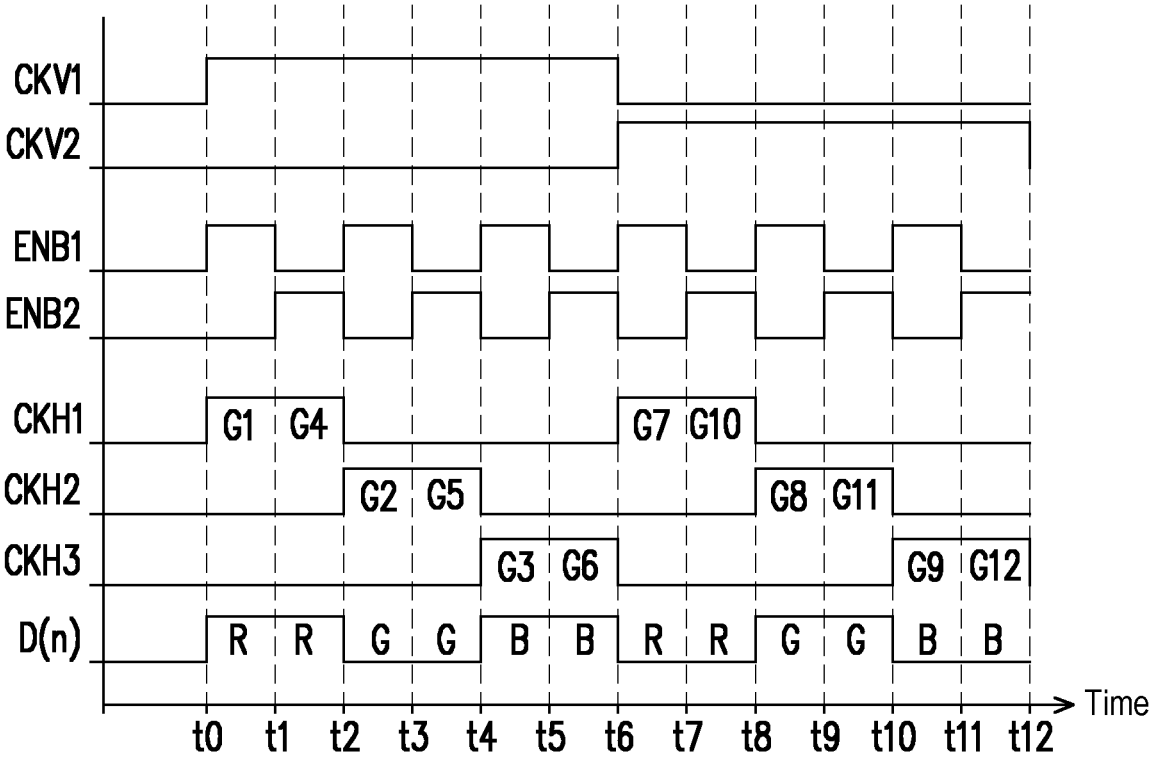
FIG. 3A is a driving timing diagram of the embodiment of FIG. 2 according to the disclosure.

FIG. 3A is a driving timing diagram of the embodiment of FIG. 2 according to the disclosure. Referring to FIG. 2 and FIG. 3A, in this embodiment, the shift register 221 can output output signals to the output circuit 222-1 and the output circuit 222-2. The output circuit 222-1 receives a clock signal CKV1, and the output circuit 222-2 receives a clock signal CKV2. The clock signal CKV1 and the clock signal CKV2 may be, for example, vertical clock signals. As shown in FIG. 3A, timings of the clock signal CKV1 and the clock signal CKV2 are different. Signal waveforms of the clock signal CKV1 and the clock signal CKV2 are interleaved without overlapping. In this embodiment, the output circuit 222-1 and the output circuit 222-2 determine time points for outputting the output signal OS1 and the output signal OS2 to the switching circuits 223-1 to 223-4 respectively according to the clock signal CKV1 and the clock signal CKV2. The output signal OS1 and the output signal OS2 are generated based on signal waveforms of the signals provided by the shift register 221. That is, timings of the output signal OS1 and the output signal OS2 are different in this embodiment.

In this embodiment, the switching circuit 223-1 and the switching circuit 223-3 receive a switching signal ENB1, and the switching circuit 223-2 and the switching circuit 223-4 receive a switching signal ENB2. As shown in FIG. 3A, timings of the switching signal ENB1 and the switching signal ENB2 are different. Signal waveforms of the switching signal ENB1 and the switching signal ENB2 are interleaved without overlapping. In this embodiment, the switching circuit 223-1 and the switching circuit 223-3 determine time points for outputting the driving signal DS1 and the driving signal DS3 to the switching elements 224-1 to 224-3 and the switching elements 224-7 to 224-9 of the demultiplexer circuit 224*a* and the demultiplexer circuit 224*c* according to the switching signal ENB1. The switching circuit 223-2 and the switching circuit 223-4 determine time points for outputting the driving signal DS2 and the driving signal DS4 to the switching elements 224-4 to 224-6 and the switching elements 224-10 to 224-12 of the demultiplexer circuit 224*b* and the demultiplexer circuit 224*d* according to the switching signal ENB2. In this embodiment, the driving signals DS1 to DS4 are generated based on the output signal OS1 and the output signal OS2, and timings of the driving signals DS1 to DS4 are different.

In this embodiment, each three of the switching elements 224-1 to 224-12 respectively receive three clock signals CKH1 to CKH3. Here, timings of the clock signals CKH1 to CKH3 are different. The clock signals CKH1 to CKH3 may be, for example, horizontal clock signals. As shown in FIG. 3A, the timings of the clock signals CKH1 to CKH3 are all different. Signal waveforms of the clock signals CKH1 to CKH3 are interleaved without overlapping. In this embodiment, the switching elements 224-1 to 224-12 determine time points for outputting a plurality of gate driving signals to the sub-pixel rows G1(*n*) to G12(*n*) respectively according to the clock signals CKH1 to CKH3. Here, the gate driving signals are generated based on the driving signal DS1 to DS4. It should be noted that, waveforms of the gate driving signals may correspond to waveforms of the clock signals CKH1 to CKH3 in the sub-pixel rows G1(*n*) to G12(*n*). Therefore, timings of the gate driving signals are different.

In detail, it is assumed that each of the sub-pixel row G1(*n*), the sub-pixel row G4(*n*), the sub-pixel row G7(*n*) and the sub-pixel row G10(*n*) is the red sub-pixel row; each of the sub-pixel row G2(*n*), the sub-pixel row G5(*n*), the sub-pixel row G8(*n*) and the sub-pixel row G11(*n*) is the green sub-pixel row; and each of the sub-pixel row G3(*n*), the sub-pixel row G6(*n*), the sub-pixel row G9(*n*) and the sub-pixel row G12(*n*) is the blue sub-pixel row. According to the timing design of the clock signals CKH1 to CKH3 in FIG. 3A, from time t0 to time t12, the sub-pixel row G1(*n*), the sub-pixel row G4(*n*), the sub-pixel row G2(*n*), the sub-pixel row G5(*n*), the sub-pixel row G3(*n*), the sub-pixel row G6(*n*), the sub-pixel row G7(*n*), the sub-pixel row G10(*n*), the sub-pixel row G8(*n*), the sub-pixel row G11(*n*), the sub-pixel row G9(*n*) and the sub-pixel row G12(*n*) of this embodiment receive the gate driving signals in sequence. In this regard, the red sub-pixel row G1(*n*) and the red sub-pixel row G4(*n*) respectively receive the gate driving signals in time interval t0-t1 and time interval t1-t2 in sequence. Therefore, the data signal D(n) can continuously provide a signal waveform (R) of the red sub-pixel during time interval t0-t2 without switching signals. The green sub-pixel row G2(*n*) and the green sub-pixel row G5(*n*) respectively receive the gate driving signals in time interval t2-t3 and time interval t3-t4 in sequence. Therefore, the data signal D(n) can continuously provide a signal waveform (G) of the green sub-pixel during time interval t2-t4 without switching signals. The blue sub-pixel row G3(*n*) and the blue sub-pixel row G6(*n*) respectively receive the gate driving signals in time interval t4-t5 and time interval t5-t6 in sequence. Therefore, the data signal D(n) can continuously provide a signal waveform (B) of the blue sub-pixel during time interval t4-t6 without switching signals. By analogy, the data signal D(n) only needs to be switched three times between time intervals t6-t12 to correspond to different colors. In other words, in conjunction with the driving timing result of FIG. 3A, the electronic device 200 of this embodiment may effectively reduce the number of times of the signal waveform of the data signal D(n) is switched when the pixel array 210 displays a frame (e.g., a pure color or a single color frame), and accordingly reduce power consumption. For example, the data signal D(n) can provide a different waveform signals for a sub-pixel of a different color, and can provide the same waveform signal for the sub-pixel of the same color. That is, the waveform switching may occur, for example, in a signal conversion when the data signal is provided to the sub-pixel of the different color. In other embodiments, the waveform switching may be, for example, a switching between signals with different voltages. Accordingly, through the switching signal ENB1 and the switching signal ENB2 with interleaved waveforms provided by the switching circuit 223-1 and the switching circuit 223-2, a timing (e.g., in the time interval t0-t2) of the data signal D(n) with the same waveform (e.g., the data signal D(n) of the sub-pixel row of the same color) can correspond to one switching signal ENB1 and one switching signal EBN2 to reduce power consumption of the electronic device.

It should be noted that, the data signal D(n) shown in FIG. 3A represents the time when the signal is converted into a waveform of different color data, rather than the actual signal waveform. In addition, the clock signal CKV1, the clock signal CKV2, the switch signal ENB1, the switch signal ENB2, and the clock signals CKH1 to CKH3 shown in FIG. 3A are ideal square wave waveforms. However, because a rising edge and a falling edge of the waveform both have a rising time and a falling time in the actual signal waveform, the actual signal waveform may be in the form of a slope or a curve at the rising edge and the falling edge of the waveform.

Figure 3B:
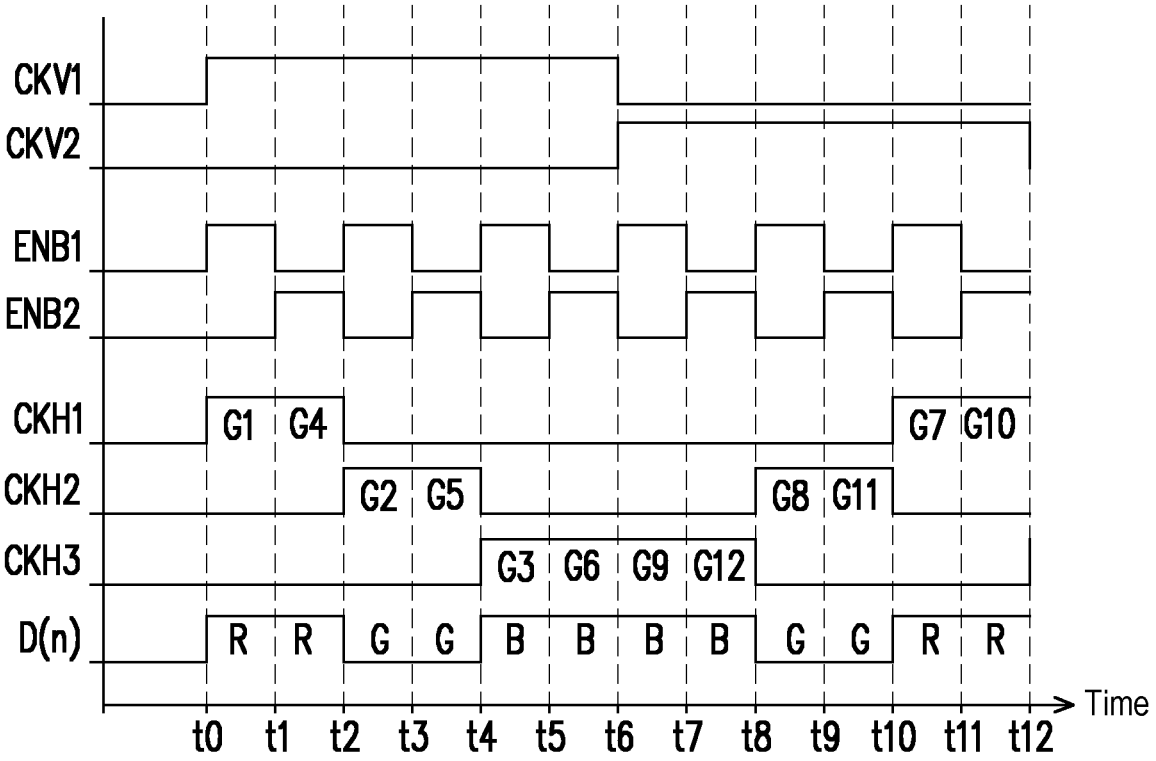
FIG. 3B is another driving timing diagram of the embodiment of FIG. 2 according to the disclosure.

FIG. 3B is another driving timing diagram of the embodiment of FIG. 2 according to the disclosure. Referring to FIG. 2 and FIG. 3B, unlike FIG. 3A, according to the timing design of the clock signals CKH1 to CKH3 in FIG. 3B, from time t0 to time t12, the sub-pixel row G1(*n*), the sub-pixel row G4(*n*), the sub-pixel row G2(*n*), the sub-pixel row G5(*n*), the sub-pixel row G3(*n*), the sub-pixel row G6(*n*), the sub-pixel row G9(*n*), the sub-pixel row G12(*n*), the sub-pixel row G8(*n*), the sub-pixel row G11(*n*), the sub-pixel row G7(*n*) and the sub-pixel row G10(*n*) of this embodiment receive the gate driving signals in sequence. In this regard, the red sub-pixel row G1(*n*) and the red sub-pixel row G4(*n*) respectively receive the gate driving signals in time interval t0-t1 and time interval t1-t2 in sequence. Therefore, the data signal D(n) can continuously provide a signal waveform (R) of the red sub-pixel during time interval t0-t2 without switching signals. The green sub-pixel row G2(*n*) and the green sub-pixel row G5(*n*) respectively receive the gate driving signals in time interval t2-t3 and time interval t3-t4 in sequence. Therefore, the data signal D(n) can continuously provide a signal waveform (G) of the green sub-pixel during time interval t2-t4 without switching signals. The blue sub-pixel row G3(*n*), the blue sub-pixel row G6(*n*), the blue sub-pixel row G9(*n*) and the blue sub-pixel row G12(*n*) respectively receive the gate driving signals in time interval t4-t5, time interval t5-t6, time interval t6-t7 and time interval t7-t8 in sequence. Therefore, the data signal D(n) can continuously provide a signal waveform (B) of the blue sub-pixel during time interval t4-t8 without switching signals. The green sub-pixel row G8(*n*) and the green sub-pixel row G11(*n*) respectively receive the gate driving signals in time interval t8-t9 and time interval t9-t10 in sequence. Therefore, the data signal D(n) can continuously provide a signal waveform (G) of the green sub-pixel during time interval t8-t10 without switching signals. The red sub-pixel row G7(*n*) and the red sub-pixel row G10(*n*) respectively receive the gate driving signals in time interval t10411 and time interval t1-t12 in sequence. Therefore, the data signal D(n) can continuously provide a signal waveform (R) of the red sub-pixel during time interval t10-t12 without switching signals. That is to say, in conjunction with the driving timing result of FIG. 3B, the timing of the data signal D(n) with the same waveform may correspond to the timing(s) of one or more than one switching signal ENB1 and one or more than one switching signal ENB2. Therefore, the electronic device 200 of this embodiment may also effectively reduce the number of times of the signal waveform of the data signal D(n) is switched when the pixel array 210 displays a frame (e.g., a pure color or a single color frame), and accordingly reduce power consumption of the electronic device 200.

Figure 4:
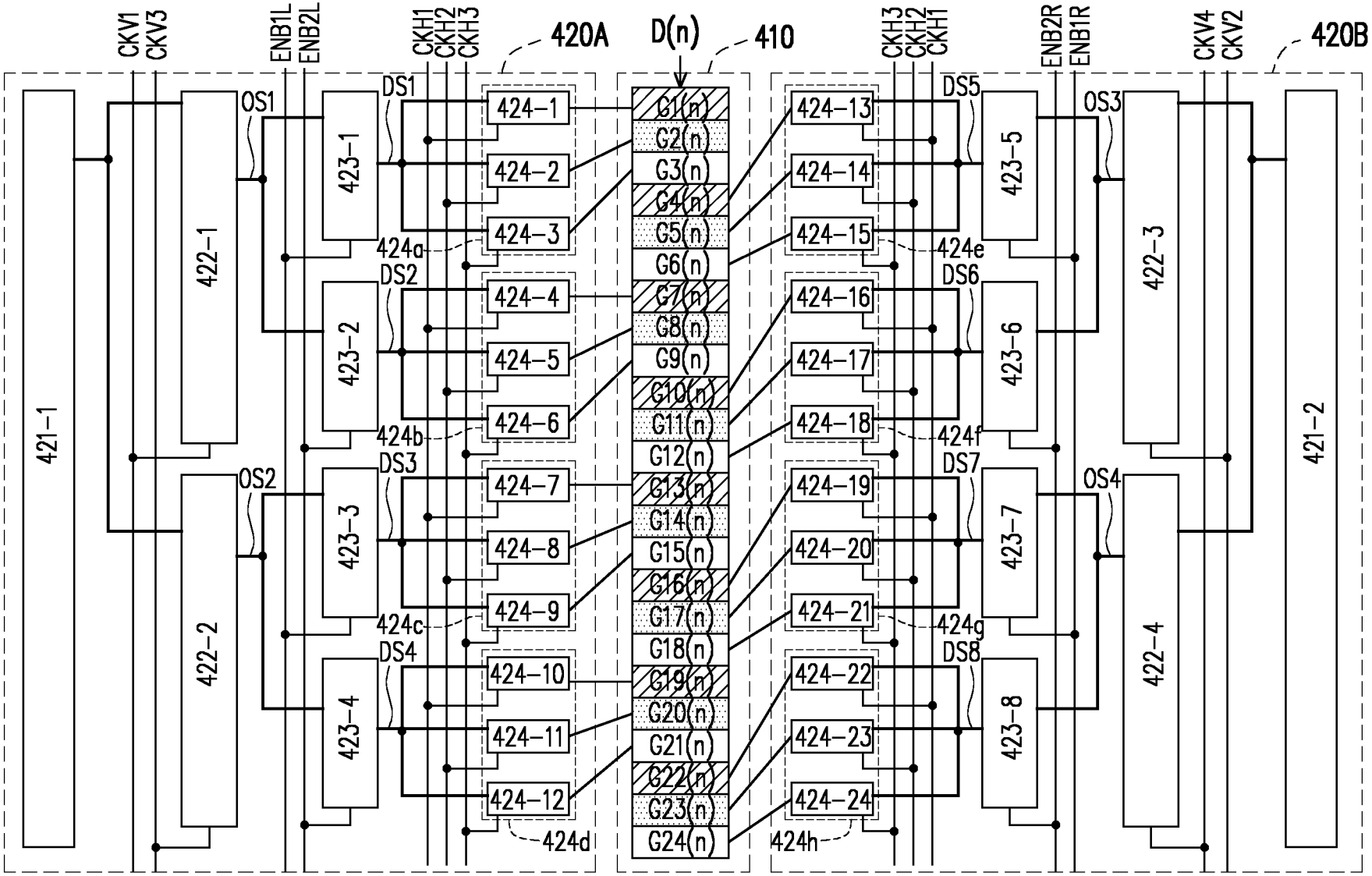
FIG. 4 is a schematic diagram of driving circuits on two sides according an embodiment of the disclosure.

FIG. 4 is a schematic diagram of driving circuits on two sides according an embodiment of the disclosure. Referring to FIG. 4, a pixel array 410 of an electronic device 400 may include a plurality of sub-pixel rows G1(*n*) to G24(*n*), where n is the number of columns, and is a positive integer greater than or equal to 1. The sub-pixel rows G1(*n*) to G24(*n*) may also correspond to the first to the twenty fourth gate lines of the pixel array 410. It should be noted that, the number of rows of the pixel array 410 of this embodiment is not limited to the number shown in FIG. 4, and there may be more pixel rows. In this embodiment, each three rows of the sub-pixel rows G1(*n*) to G24(*n*) (e.g., the three sub-pixel rows G1(*n*) to G3(*n*)) may be a red sub-pixel row, a green sub-pixel row and a blue sub-pixel row in sequence, and each column of the three sub-pixel rows G1(*n*) to G3(*n*) may constitute one pixel (e.g., sub-pixels G1(1) to G3(1)). However, the color type and arrangement of the sub-pixels in the disclosure are not limited thereto. In this embodiment, each column of the sub-pixel rows G1(*n*) to G24(*n*) may receive a corresponding data signal D(n).

In this embodiment, a driving circuit 420A of the electronic device 400 of FIG. 4 may include a shift register 421-1, an output circuit 422-1, an output circuit 422-2, switching circuits 423-1 to 423-4 and demultiplexer circuits 424*a* to 424*d*. Here, the driving circuit 420A may be disposed at the position of the driving circuit 120 of FIG. 1 (located on one side of the pixel array 110). Each of the demultiplexer circuits 424*a* to 424*d* includes three switching elements, and switching elements 424-1 to 424-12 are respectively coupled to the sub-pixel rows G1(*n*) to G3(*n*), the sub-pixel rows G7(*n*) to G9(*n*), the sub-pixel rows G13(*n*) to G15(*n*) and the sub-pixel rows G19(*n*) to G21(*n*) of the pixel array 410. From another perspective, the driving circuit 420A is coupled to pixel rows belonging to odd rows in the pixel array 410. The switching circuits 423-1 to 423-4 are respectively coupled to the demultiplexer circuits 424*a* to 424*d*, and the switching circuits 423-1 to 423-4 respectively provide driving signals DS1 to DS4 to each corresponding three of the switching elements 424-1 to 424-12. Specifically, the switching circuit 423-1 is coupled to the demultiplexer circuit 424*a*, and the demultiplexer circuit 424*a* is coupled to the switching elements 424-1 to 424-3. The switching circuit 423-2 is coupled to the demultiplexer circuit 424*b*, and the demultiplexer circuit 424*b* is coupled to the switching elements 424-4 to 424-6. The switching circuit 423-3 is coupled to the demultiplexer circuit 424*c*, and the demultiplexer circuit 424*c* is coupled to the switching elements 424-7 to 424-9. The switching circuit 423-4 is coupled to the demultiplexer circuit 424*d*, and the demultiplexer circuit 424*d* is coupled to the switching elements 424-9 to 424-12.

In this embodiment, the shift register 421-1 is coupled to the output circuit 422-1 and the output circuit 422-2. The output circuit 422-1 and the output circuit 422-2 are coupled to the switching circuits 423-1 to 423-4, and each of the output circuit 422-1 and the output circuit 422-2 is coupled to each two of the switching circuits 423-1 to 423-4. Specifically, the output circuit 422-1 is coupled to the switching circuit 423-1 and the switching circuit 423-2, and the output circuit 422-2 is coupled to the switching circuit 423-3 and the switching circuit 423-4. It should be noted that, the numbers of the output circuits, the switching circuits and the demultiplexer circuits in this embodiment may be determined according to the number of the sub-pixel rows of the pixel array 410 rather than being limited what illustrated in FIG. 4.

In this embodiment, a driving circuit 420B of the electronic device 400 of FIG. 4 may include a shift register 421-2, an output circuit 422-3, an output circuit 422-4, switching circuits 423-5 to 423-8 and demultiplexer circuits 424*e* to 424*h*. Here, the driving circuit 420B may be located on another side of the pixel array 110 of FIG. 1 (another side opposite to the driving circuit 120). Each of the demultiplexer circuits 424*e* to 424*h* includes three switching elements, and switching elements 424-13 to 424-24 are respectively coupled to the sub-pixel rows G4(*n*) to G6(*n*), the sub-pixel rows G10(*n*) to G12(*n*), the sub-pixel rows G16(*n*) to G18(*n*) and the sub-pixel rows G22(*n*) to G24(*n*) of the pixel array 410. From another perspective, the driving circuit 420B is coupled to pixel rows belonging to even rows in the pixel array 410. The switching circuits 423-5 to 423-8 are respectively coupled to the demultiplexer circuits 424*e* to 424*h*, and the switching circuits 423-5 to 423-8 respectively provide driving signals DS5 to DS8 to each corresponding three of the demultiplexer circuits 424-13 to 424-24. Specifically, the switching circuit 423-5 is coupled to the demultiplexer circuit 424*e*, and the demultiplexer circuit 424*e* is coupled to the switching elements 424-13 to 424-15. The switching circuit 423-6 is coupled to the demultiplexer circuit 424*f*, and the demultiplexer circuit 424*f* is coupled to the switching elements 424-16 to 424-18. The switching circuit 423-7 is coupled to the demultiplexer circuit 424*g*, and the demultiplexer circuit 424*g* is coupled to the switching elements 424-19 to 424-21. The switching circuit 423-8 is coupled to the demultiplexer circuit 424*h*, and the demultiplexer circuit 424*h* is coupled to the switching elements 424-22 to 424-24.

In this embodiment, the shift register 421-2 is coupled to the output circuit 422-3 and the output circuit 422-4. The output circuit 422-3 and the output circuit 422-4 are coupled to the switching circuits 423-5 to 423-8, and each of the output circuit 422-3 and the output circuit 422-4 is coupled to each two of the switching circuits 423-5 to 423-8. Specifically, the output circuit 422-3 is coupled to the switching circuit 423-5 and the switching circuit 423-6, and the output circuit 422-4 is coupled to the switching circuit 423-7 and the switching circuit 423-8. It should be noted that, the numbers of the output circuits, the switching circuits and the demultiplexer circuits in this embodiment may be determined according to the number of the sub-pixel rows of the pixel array 410 rather than being limited what illustrated in FIG. 4.

Figure 5A:
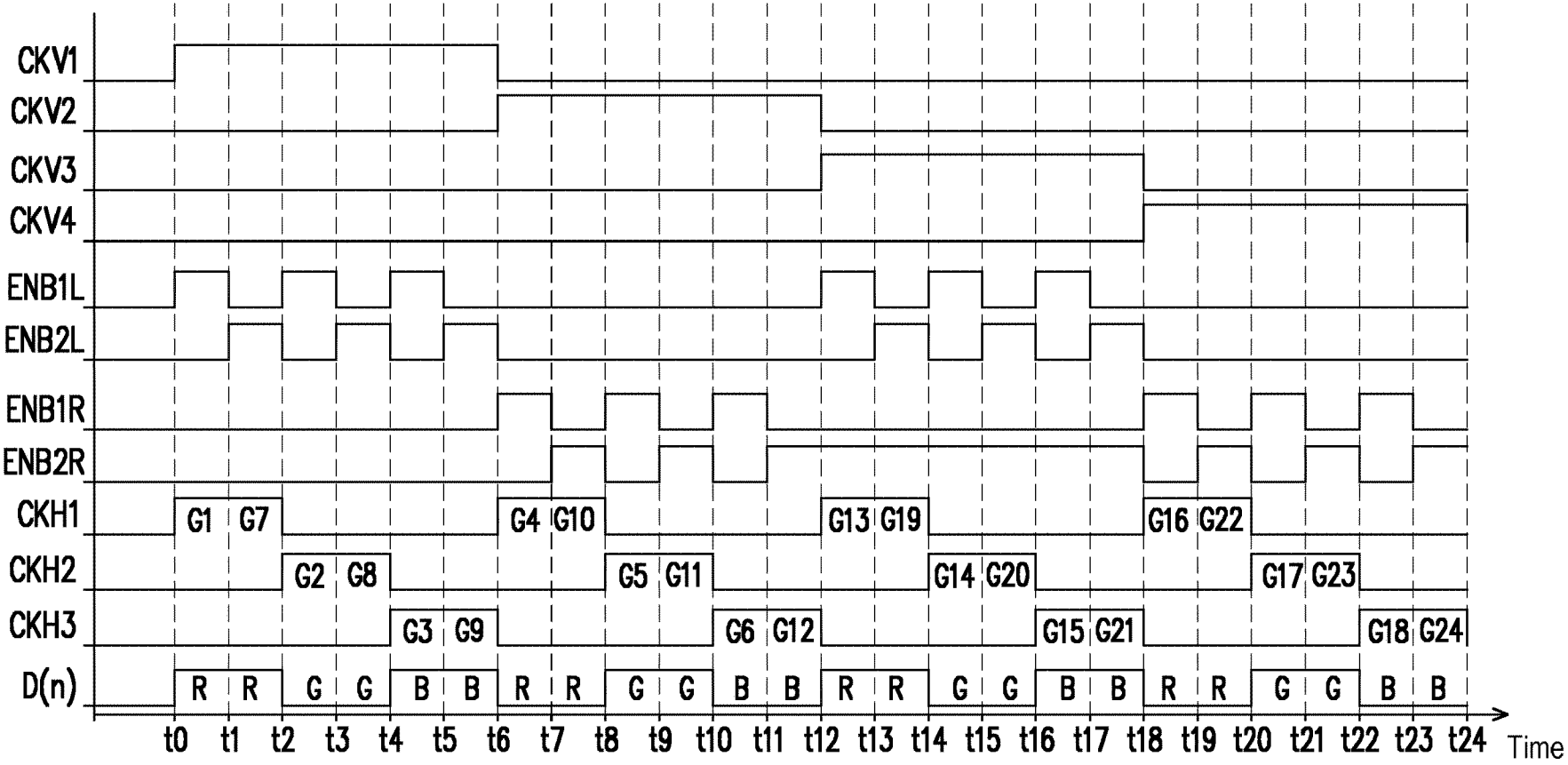
FIG. 5A is a driving timing diagram of the embodiment of FIG. 4 according to the disclosure.

FIG. 5A is a driving timing diagram of the embodiment of FIG. 4 according to the disclosure. Referring to FIG. 4 and FIG. 5A, in this embodiment, the shift register 421-1 and the shift register 421-2 may output a plurality of signals to the output circuits 422-1 to 422-4. The output circuit 422-1 receives a clock signal CKV1. The output circuit 422-2 receives a clock signal CKV3. The output circuit 422-3 receives a clock signal CKV2. The output circuit 422-4 receives a clock signal CKV4. The clock signals CKV1 to CKV4 may be, for example, vertical clock signals. As shown in FIG. 5A, timings of the clock signals CKV1 to CKV4 are different. Signal waveforms of the clock signal CKV1 to CKV4 are interleaved without overlapping. In this embodiment, the output circuits 422-1 to 422-4 determine time points for outputting a plurality of output signals OS1 to OS4 to the switching circuits 423-1 to 423-8 respectively according to the clock signals CKV1 to CKV4. The output signals OS1 to OS4 are generated based on signal waveforms of the signals provided by the shift register 421-1 and the shift register 421-2.

In this embodiment, the switching circuit 423-1 and the switching circuit 423-3 receive a switching signal ENB1L. The switching circuit 423-2 and the switching circuit 423-4 receive a switching signal ENB2L. The switching circuit 423-5 and the switching circuit 423-7 receive a switching signal ENB1R. The switching circuit 423-6 and the switching circuit 423-8 receive a switching signal ENB2R. As shown in FIG. 5A, timings of the switching signals ENB1L, ENB2L, ENB1R and ENB2R are all different. Signal waveforms of the switching signal ENB1L, the switching signal ENB2L, the switching signal ENB1R and the switching signal ENB2R are interleaved without overlapping. In this embodiment, the switching circuit 423-1 and the switching circuit 423-3 determine time points for outputting the driving signal DS1 and the driving signal DS3 to the demultiplexer circuits 424-1 to 424-3 and the demultiplexer circuits 424-7 to 424-9 according to the switching signal ENB1L. The switching circuit 423-2 and the switching circuit 423-4 determine time points for outputting the driving signal DS2 and the driving signal DS4 to the demultiplexer circuits 424-4 to 424-6 and the demultiplexer circuits 424-10 to 424-12 according to the switching signal ENB2L. The switching circuit 423-5 and the switching circuit 423-7 determine time points for outputting the driving signal DS5 and the driving signal DS7 to the demultiplexer circuits 424-13 to 424-15 and the demultiplexer circuits 424-19 to 424-21 according to the switching signal ENB1R. The switching circuit 423-6 and the switching circuit 423-8 determine time points for outputting the driving signal DS6 and the driving signal DS8 to the demultiplexer circuits 424-16 to 424-18 and the demultiplexer circuits 424-22 to 424-24 according to the switching signal ENB2R. In this embodiment, the driving signals DS1 to DS8 are generated based on said signals, and timings of the driving signals DS1 to DS8 are different.

In this embodiment, each three of the switching elements 424-1 to 424-24 respectively receive three clock signals CKH1 to CKH3. Here, the timings of the clock signals CKH1 to CKH3 are different. The clock signals CKH1 to CKH3 may be, for example, horizontal clock signals. As shown in FIG. 5A, the timings of the clock signals CKH1 to CKH3 are all different. Signal waveforms of the clock signals CKH1 to CKH3 are interleaved without overlapping.

In this embodiment, the switching elements 424-1 to 424-24 determine time points for outputting a plurality of gate driving signals to the sub-pixel rows G1(*n*) to G24(*n*) respectively according to the clock signals CKH1 to CKH3. Here, the gate driving signals are generated based on the driving signal DS1 to DS8. It should be noted that, waveforms of the gate driving signals may correspond to waveforms of the clock signals CKH1 to CKH3 in the sub-pixel rows G1(*n*) to G24(*n*). Therefore, timings of the gate driving signals are different.

In detail, it is assumed that each of the sub-pixel row G1(*n*), the sub-pixel row G4(*n*), the sub-pixel row G7(*n*), the sub-pixel row G10(*n*), the sub-pixel row G13(*n*), the sub-pixel row G16(*n*), the sub-pixel row G19(*n*) and the sub-pixel row G22(*n*) is the red sub-pixel row; each of the sub-pixel row G2(*n*), the sub-pixel row G5(*n*), the sub-pixel row G8(*n*), the sub-pixel row G11(*n*), the sub-pixel row G14(*n*), the sub-pixel row G17(*n*), the sub-pixel row G20(*n*) and the sub-pixel row G23(*n*) is the green sub-pixel row; each of the sub-pixel row G3(*n*), the sub-pixel row G6(*n*), the sub-pixel row G9(*n*), the sub-pixel row G12(*n*), the sub-pixel row G15(*n*), the sub-pixel row G18(*n*), the sub-pixel row G21(*n*) and the sub-pixel row G24(*n*) is the blue sub-pixel row. According to the timing design of the clock signals CKH1 to CKH3 in FIG. 5A, from time t0 to time t24, the sub-pixel row G1(*n*), the sub-pixel row G7(*n*), the sub-pixel row G2(*n*), the sub-pixel row G8(*n*), the sub-pixel row G3(*n*), the sub-pixel row G9(*n*), the sub-pixel row G4(*n*), the sub-pixel row G10(*n*), the sub-pixel row G5(*n*), the sub-pixel row G11(*n*), the sub-pixel row G6(*n*), the sub-pixel row G12(*n*), the sub-pixel row G13(*n*), the sub-pixel row G19(*n*), the sub-pixel row G14(*n*), the sub-pixel row G20(*n*), the sub-pixel row G15(*n*), the sub-pixel row G21(*n*), the sub-pixel row G16(*n*), the sub-pixel row G22(*n*), the sub-pixel row G17(*n*), the sub-pixel row G23(*n*), the sub-pixel row G18(*n*) and the sub-pixel row G24(*n*) of this embodiment receive the gate driving signals in sequence. In this regard, the red sub-pixel row G1(*n*) and the red sub-pixel row G7(*n*) respectively receive the gate driving signals in time interval t0-t1 and time interval t1-t2 in sequence. Therefore, the data signal D(n) can continuously provide a signal waveform (R) of the red sub-pixel during time interval t0-t2 without switching signals. The green sub-pixel row G2(*n*) and the green sub-pixel row G8(*n*) respectively receive the gate driving signals in time interval t2-t3 and time interval t3-t4 in sequence. Therefore, the data signal D(n) can continuously provide a signal waveform (G) of the green sub-pixel during time interval t2-t4 without switching signals. The blue sub-pixel row G3(*n*) and the blue sub-pixel row G9(*n*) respectively receive the gate driving signals in time interval t4-t5 and time interval t5-t6 in sequence. Therefore, the data signal D(n) can continuously provide a signal waveform (B) of the blue sub-pixel during time interval t4-t6 without switching signals. By analogy, the data signal D(n) only needs to be switched nine times between time intervals t6-t24 to correspond to different colors. That is to say, in conjunction with the driving timing result of FIG. 5A, the timing of the data signal D(n) with the same waveform can correspond to timings of one switching signal ENB1L and one switching signal ENB2L or timings of one switching signal ENB1R and one switching signal ENB2R. Therefore, the electronic device 400 of this embodiment may also effectively reduce the number of times of the signal waveform of the data signal D(n) is switched when the pixel array 410 displays a frame (e.g., a pure color or a single color frame), and accordingly reduce power consumption of the electronic device 400.

Figure 5B:
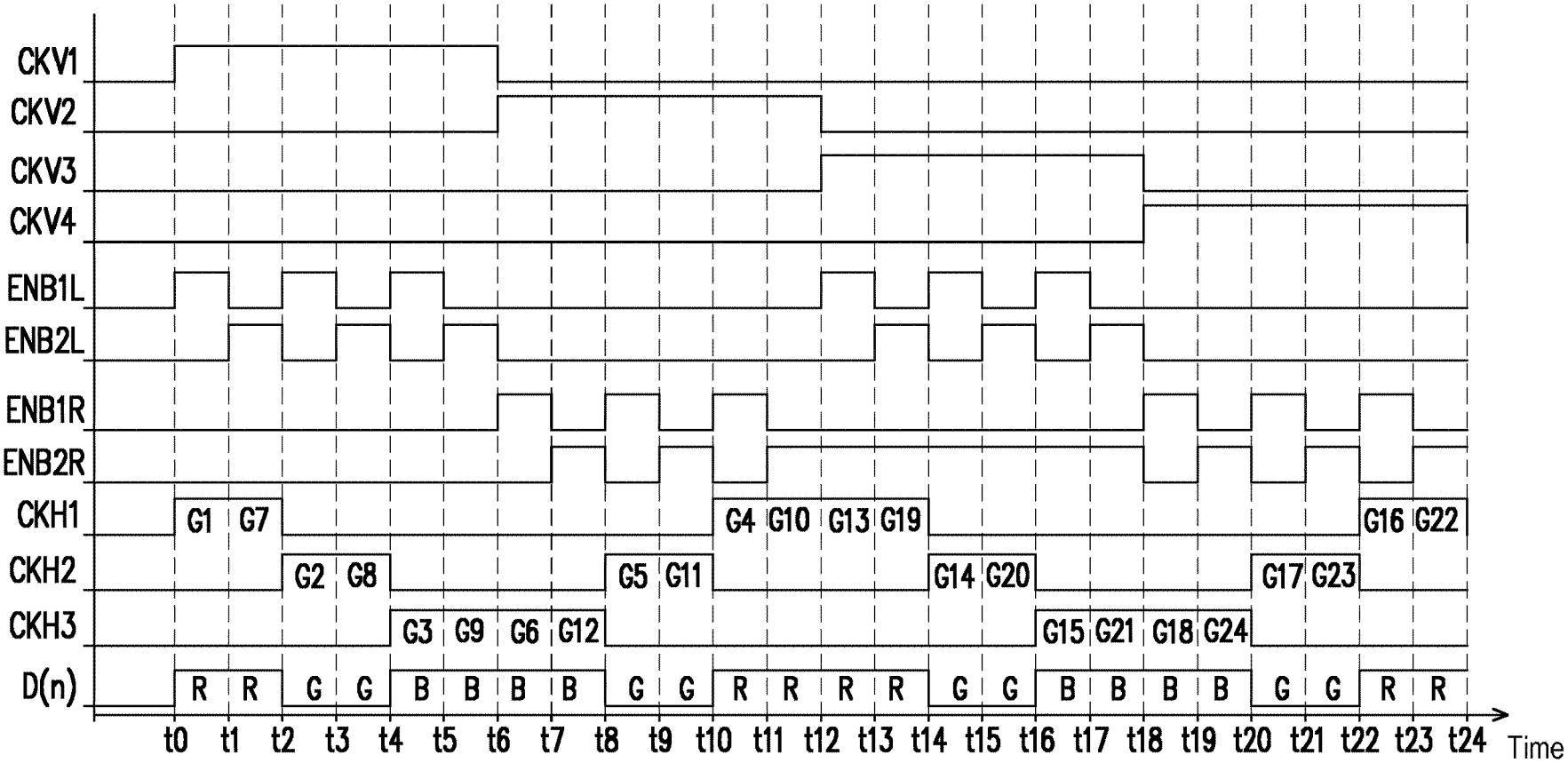
FIG. 5B is another driving timing diagram of the embodiment of FIG. 4 according to the disclosure.

FIG. 5B is another driving timing diagram of the embodiment of FIG. 4 according to the disclosure. Referring to FIG. 4 and FIG. 5B, unlike FIG. 5A, according to the timing design of the clock signals CKH1 to CKH3 in FIG. 5B, from time t0 to time t24, the sub-pixel row G1(*n*), the sub-pixel row G7(*n*), the sub-pixel row G2(*n*), the sub-pixel row G8(*n*), the sub-pixel row G3(*n*), the sub-pixel row G9(*n*), the sub-pixel row G6(*n*), the sub-pixel row G12(*n*), the sub-pixel row G5(*n*), the sub-pixel row G11(*n*), the sub-pixel row G4(*n*), the sub-pixel row G10(*n*), the sub-pixel row G13(*n*), the sub-pixel row G19(*n*), the sub-pixel row G14(*n*), the sub-pixel row G20(*n*), the sub-pixel row G15(*n*), the sub-pixel row G21(*n*), the sub-pixel row G18(*n*), the sub-pixel row G24(*n*), the sub-pixel row G17(*n*), the sub-pixel row G23(*n*), the sub-pixel row G16(*n*) and the sub-pixel row G22(*n*) of this embodiment receive the gate driving signals in sequence. In this regard, the red sub-pixel row G1(*n*) and the red sub-pixel row G7(*n*) respectively receive the gate driving signals in time interval t0-t1 and time interval t1-t2 in sequence. Therefore, the data signal D(n) can continuously provide a signal waveform (R) of the red sub-pixel during time interval t0-t2 without switching signals. The green sub-pixel row G2(*n*) and the green sub-pixel row G8(*n*) respectively receive the gate driving signals in time interval t2-t3 and time interval t3-t4 in sequence. Therefore, the data signal D(n) can continuously provide a signal waveform (G) of the green sub-pixel during time interval t2-t4 without switching signals. The blue sub-pixel row G3(*n*), the blue sub-pixel row G9(*n*), the blue sub-pixel row G6(*n*) and the blue sub-pixel row G12(*n*) respectively receive the gate driving signals in time interval t4-t5, time interval t5-t6, time interval t6-t7 and time interval t7-t8 in sequence. Therefore, the data signal D(n) can continuously provide a signal waveform (B) of the blue sub-pixel during time interval t4-t8 without switching signals. The green sub-pixel row G5(*n*) and the green sub-pixel row G11(*n*) respectively receive the gate driving signals in time interval t8-t9 and time interval t9-t10 in sequence. Therefore, the data signal D(n) can continuously provide a signal waveform (G) of the green sub-pixel during time interval t8-t10 without switching signals. The red sub-pixel row G4(*n*) and the red sub-pixel row G10(*n*) respectively receive the gate driving signals in time interval t10-t11 and time interval t11-t12 in sequence. Therefore, the data signal D(n) can continuously provide a signal waveform (R) of the red sub-pixel during time interval t10-t12 without switching signals. That is to say, in conjunction with the driving timing result of FIG. 5B, the timing of the data signal D(n) with the same waveform may correspond to timings of one or more than one switching signal ENB1L and one or more than one switching signal ENB2L, or correspond to timings of one or more than one switching signal ENB1R and one or more than one switching signal ENB2R. Therefore, the electronic device 400 of this embodiment may also effectively reduce the number of times the signal waveform of the data signal D(n) is switched when the pixel array 410 displays a frame (e.g., a pure color or a single color frame), and accordingly reduce power consumption of the electronic device 400.

Figure 6:
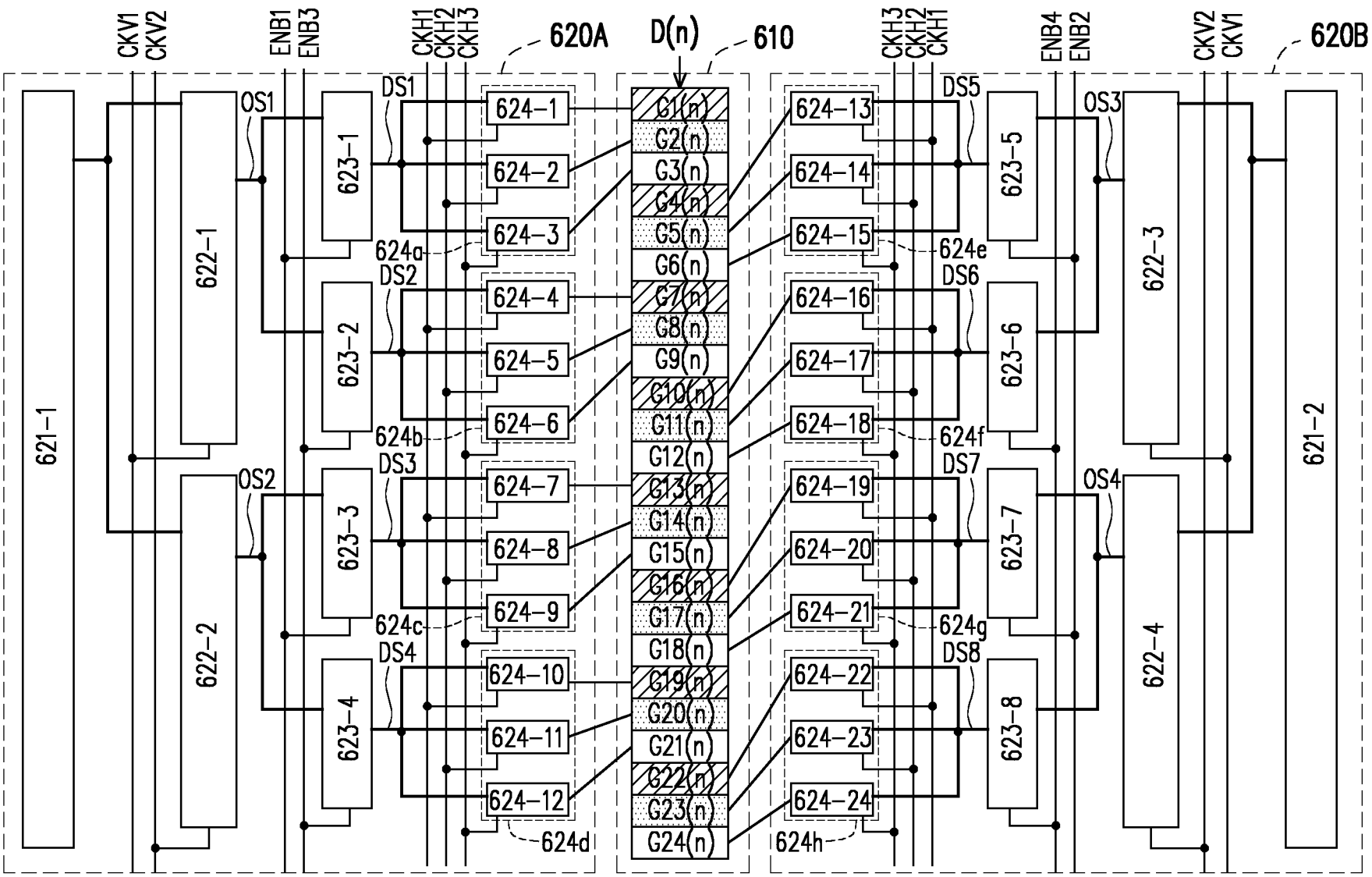
FIG. 6 is a schematic diagram of driving circuits on two sides according another embodiment of the disclosure.

FIG. 6 is a schematic diagram of driving circuits on two sides according another embodiment of the disclosure. Referring to FIG. 6, a pixel array 610 of an electronic device 600 may include a plurality of sub-pixel rows G1(*n*) to G24(*n*), where n is the number of columns, and is a positive integer greater than or equal to 1. The sub-pixel rows G1(*n*) to G24(*n*) may also correspond to the first to the twenty fourth gate lines of the pixel array 610. In this embodiment, a driving circuit 620A of the electronic device 600 of FIG.

6 may include a shift register 621-1, an output circuit 622-1, an output circuit 622-2, switching circuits 623-1 to 623-4 and demultiplexer circuits 624*a* to 624*d*. Here, the driving circuit 620A may be disposed at the position of the driving circuit 120 of FIG. 1 (located on one side of the pixel array 110). In this embodiment, a driving circuit 620B of the electronic device 600 of FIG. 6 may include a shift register 621-2, an output circuit 622-3, an output circuit 622-4, switching circuits 623-5 to 623-8 and demultiplexer circuits 624*e* to 624*h*. Here, the driving circuit 620B may be located on another side of the pixel array 110 of FIG. 1 (another side opposite to the driving circuit 120). The circuit configuration of this embodiment is the same as that of FIG. 4, but the difference is that the clock signals and switching signals received by the output circuits 622-1 to 622-4 and the switching circuits 623-1 to 623-8 of this embodiment are different from those of FIG. 4.

Figure 7A:
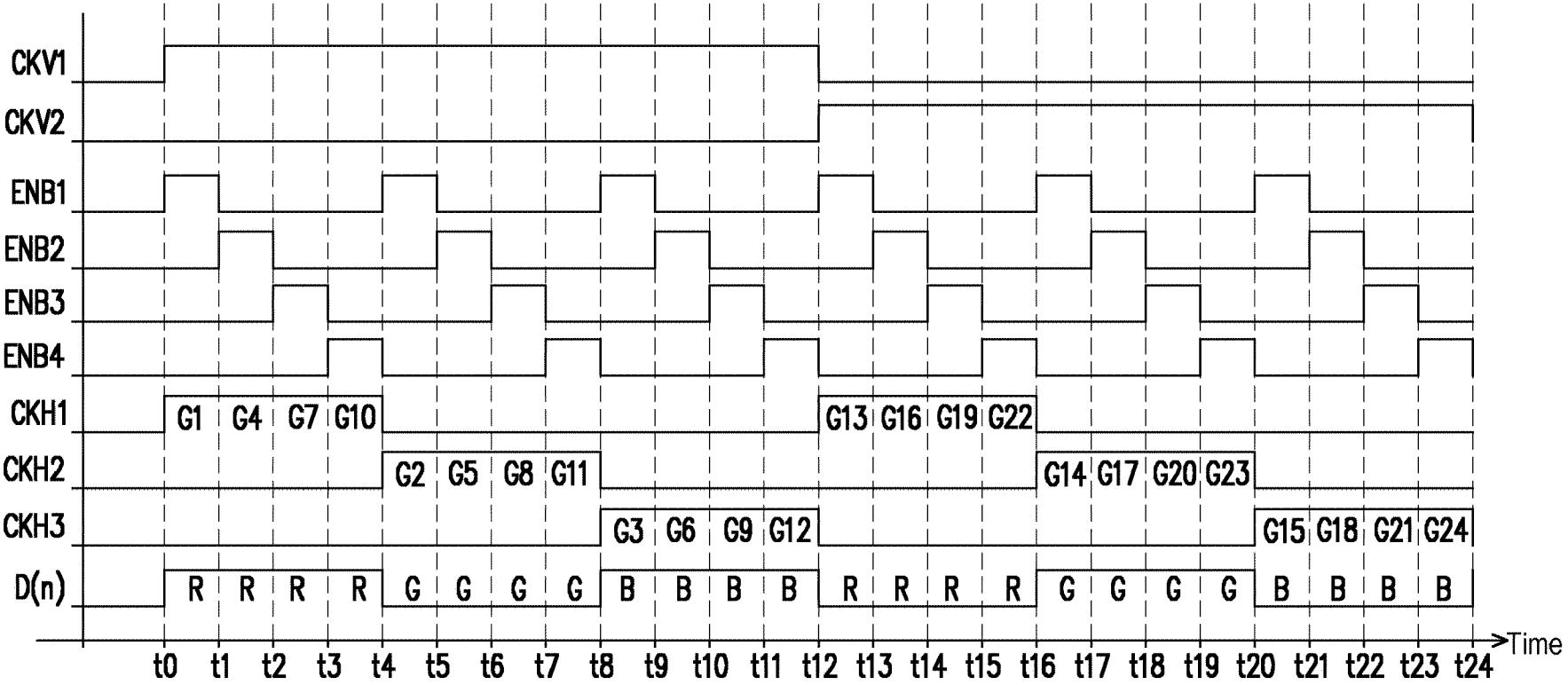
FIG. 7A is a driving timing diagram of the embodiment of FIG. 6 according to the disclosure.

FIG. 7A is a driving timing diagram of the embodiment of FIG. 6 according to the disclosure. Referring to FIG. 6 and FIG. 7A, in this embodiment, the shift register 621-1 and the shift register 621-2 can output a plurality of signals to the output circuits 622-1 to 622-4. The output circuit 622-1 and the output circuit 622-3 receive the clock signal CKV1. The output circuit 622-2 and the output circuit 622-4 receive the clock signal CKV2. The clock signal CKV1 and the clock signal CKV2 may be, for example, vertical clock signals. As shown in FIG. 7A, timings of the clock signal CKV1 and the clock signal CKV2 are different. Signal waveforms of the clock signal CKV1 and the clock signal CKV2 are interleaved without overlapping. In this embodiment, the output circuits 622-1 to 622-4 determine time points for outputting a plurality of output signals OS1 to OS4 to the switching circuits 623-1 to 623-8 respectively according to the clock signal CKV1 and the clock signal CKV2. The output signals OS1 to OS4 are generated based on signal waveforms of the signals provided by the shift register 621-1 and the shift register 621-2.

In this embodiment, the switching circuit 623-1 and the switching circuit 623-3 receive a switching signal ENB1. The switching circuit 623-2 and the switching circuit 623-4 receive a switching signal ENB3. The switching circuit 623-5 and the switching circuit 623-7 receive a switching signal ENB2. The switching circuit 623-6 and the switching circuit 623-8 receive a switching signal ENB4. As shown in FIG. 7A, timing of the switching signal ENB1, the switching signal ENB2, the switching signal ENB3 and the switching signal ENB4 are all different. Signal waveforms of the switching signal ENB1, the switching signal ENB2, the switching signal ENB3 and the switching signal ENB4 are interleaved without overlapping. In this embodiment, the switching circuit 623-1 and the switching circuit 623-3 determine time points for outputting the driving signal DS1 and the driving signal DS3 to switching elements 624-1 to 624-3 and switching elements 624-7 to 624-9 according to the switching signal ENB1. The switching circuit 623-2 and the switching circuit 623-4 determine time points for outputting the driving signal DS2 and the driving signal DS4 to switching elements 624-4 to 624-6 and switching elements 624-10 to 624-12 according to the switching signal ENB3. The switching circuit 623-5 and the switching circuit 623-7 determine time points for outputting the driving signal DS5 and the driving signal DS7 to the switching elements 624-13 to 624-15 and the switching elements 624-19 to 624-21 according to the switching signal ENB2. The switching circuit 623-6 and the switching circuit 623-8 determine time points for outputting the driving signal DS6 and the driving signal DS8 to the switching elements 624-16 to 624-18 and the switching elements 624-22 to 624-24 according to the switching signal ENB4. In this embodiment, the driving signals DS1 to DS8 are generated based on the output signals OS1 to OS4, and timings of the driving signals DS1 to DS8 are different.

In this embodiment, each three of the switching elements 624-1 to 624-24 respectively receive three clock signals CKH1 to CKH3. Here, timings of the clock signals CKH1 to CKH3 are different. The clock signals CKH1 to CKH3 may be, for example, horizontal clock signals. As shown in FIG. 7A, the timings of the clock signals CKH1 to CKH3 are all different. Signal waveforms of the clock signals CKH1 to CKH3 are interleaved without overlapping. In this embodiment, the switching elements 624-1 to 624-24 determine time points for outputting a plurality of gate driving signals to the sub-pixel rows G1(*n*) to G24(*n*) respectively according to the clock signals CKH1 to CKH3. Here, the gate driving signals are generated based on the driving signal DS1 to DS8. It should be noted that, waveforms of the gate driving signals may correspond to waveforms of the clock signals CKH1 to CKH3 in the sub-pixel rows G1(*n*) to G24(*n*). Therefore, timings of the gate driving signals are different.

In detail, it is assumed that each of the sub-pixel row G1(*n*), the sub-pixel row G4(*n*), the sub-pixel row G7(*n*), the sub-pixel row G10(*n*), the sub-pixel row G13(*n*), the sub-pixel row G16(*n*), the sub-pixel row G19(*n*) and the sub-pixel row G22(*n*) is the red sub-pixel row; each of the sub-pixel row G2(*n*), the sub-pixel row G5(*n*), the sub-pixel row G8(*n*), the sub-pixel row G11(*n*), the sub-pixel row G14(*n*), the sub-pixel row G17(*n*), the sub-pixel row G20(*n*) and the sub-pixel row G23(*n*) is the green sub-pixel row; each of the sub-pixel row G3(*n*), the sub-pixel row G6(*n*), the sub-pixel row G9(*n*), the sub-pixel row G12(*n*), the sub-pixel row G15(*n*), the sub-pixel row G18(*n*), the sub-pixel row G21(*n*) and the sub-pixel row G24(*n*) is the blue sub-pixel row. According to the timing design of the clock signals CKH1 to CKH3 in FIG. 7A, from time t0 to time t24, the sub-pixel row G1(*n*), the sub-pixel row G4(*n*), the sub-pixel row G7(*n*), the sub-pixel row G10(*n*), the sub-pixel row G2(*n*), the sub-pixel row G5(*n*), the sub-pixel row G8(*n*), the sub-pixel row G11(*n*), the sub-pixel row G3(*n*), the sub-pixel row G6(*n*), the sub-pixel row G9(*n*), the sub-pixel row G12(*n*), the sub-pixel row G13(*n*), the sub-pixel row G16(*n*), the sub-pixel row G19(*n*), the sub-pixel row G22(*n*), the sub-pixel row G14(*n*), the sub-pixel row G17(*n*), the sub-pixel row G20(*n*), the sub-pixel row G23(*n*), the sub-pixel row G15(*n*), the sub-pixel row G18(*n*), the sub-pixel row G21(*n*) and the sub-pixel row G24(*n*) of this embodiment receive the gate driving signals in sequence. In this regard, the red sub-pixel row G1(*n*), the red sub-pixel row G4(*n*), the red sub-pixel row G7(*n*) and the red sub-pixel row G10(*n*) respectively receive the gate driving signals in time interval t0-t1, time interval t1-t2, time interval t2-t3 and time interval t3-t4 in sequence. Therefore, the data signal D(n) can continuously provide a signal waveform (R) of the red sub-pixel during time interval t0-t4 without switching signals. The green sub-pixel row G2(*n*), the green sub-pixel row G5(*n*), the green sub-pixel row G8(*n*) and the green sub-pixel row G11(*n*) respectively receive the gate driving signals in time interval t4-t5, time interval t5-t6, time interval t6-t7 and time interval t7-t8 in sequence. Therefore, the data signal D(n) can continuously provide a signal waveform (G) of the green sub-pixel during time interval t4-t8 without switching signals. The blue sub-pixel row G3(*n*), the blue sub-pixel row G6(*n*), the blue sub-pixel row G9(*n*) and the blue sub-pixel row G12(*n*)

respectively receive the gate driving signals in time interval t8-t9, time interval t9-t10, time interval t10-t11 and time interval t11-t12 in sequence. Therefore, the data signal D(n) can continuously provide a signal waveform (B) of the blue sub-pixel during time interval t8-t12 without switching signals. By analogy, the data signal D(n) only needs to be switched three times between time intervals t12-t24 to correspond to different colors. That is to say, in conjunction with the driving timing result of FIG. 7A, the timing of the data signal D(n) with the same waveform (e.g., in time interval t0 to t4) may correspond to timings of one switching signal ENB1, one switching signal ENB2, one switching signal ENB3 and one switching signal ENB4 to reduce power consumption of the electronic device. Therefore, the electronic device 600 of this embodiment may also effectively reduce the number of times of the signal waveform of the data signal D(n) is switched when the pixel array 610 displays a frame (e.g., a pure color or a single color frame), and accordingly reduce power consumption of the electronic device 600.

Figure 7B:
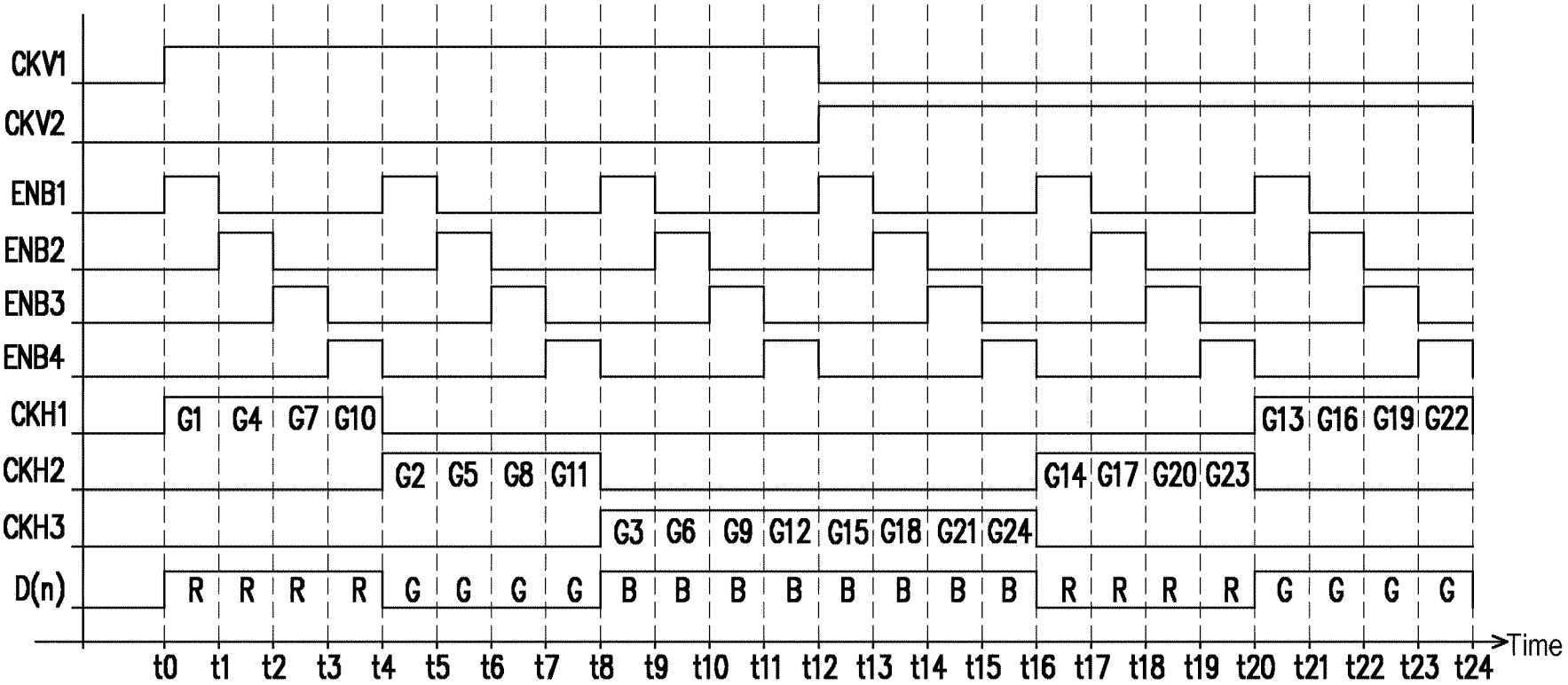
FIG. 7B is another driving timing diagram of the embodiment of FIG. 6 according to the disclosure.

FIG. 7B is another driving timing diagram of the embodiment of FIG. 6 according to the disclosure. Referring to FIG. 6 and FIG. 7B, unlike FIG. 7A, according to the timing design of the clock signals CKH1 to CKH3 in FIG. 7B, from time t0 to time t24, the sub-pixel row G1(*n*), the sub-pixel row G4(*n*), the sub-pixel row G7(*n*), the sub-pixel row G10(*n*), the sub-pixel row G2(*n*), the sub-pixel row G5(*n*), the sub-pixel row G8(*n*), the sub-pixel row G11(*n*), the sub-pixel row G3(*n*), the sub-pixel row G6(*n*), the sub-pixel row G9(*n*), the sub-pixel row G12(*n*), the sub-pixel row G15(*n*), the sub-pixel row G18(*n*), the sub-pixel row G21(*n*), the sub-pixel row G24(*n*), the sub-pixel row G14(*n*), the sub-pixel row G17(*n*), the sub-pixel row G20(*n*), the sub-pixel row G23(*n*), the sub-pixel row G13(*n*), the sub-pixel row G16(*n*), the sub-pixel row G19(*n*) and the sub-pixel row G22(*n*) of this embodiment receive the gate driving signals in sequence. In this regard, the red sub-pixel row G1(*n*), the red sub-pixel row G4(*n*), the red sub-pixel row G7(*n*) and the red sub-pixel row G10(*n*) respectively receive the gate driving signals in time interval t0-t1, time interval t1-t2, time interval t2-t3 and time interval t3-t4 in sequence. Therefore, the data signal D(n) can continuously provide a signal waveform (R) of the red sub-pixel during time interval t0-t4 without switching signals. The green sub-pixel row G2(*n*), the green sub-pixel row G5(*n*), the green sub-pixel row G8(*n*) and the green sub-pixel row G11(*n*) respectively receive the gate driving signals in time interval t4-t5, time interval t5-t6, time interval t6-t7 and time interval t7-t8 in sequence. Therefore, the data signal D(n) can continuously provide a signal waveform (G) of the green sub-pixel during time interval t4-t8 without switching signals. The blue sub-pixel row G3(*n*), the blue sub-pixel row G6(*n*), the blue sub-pixel row G9(*n*), the blue sub-pixel row G12(*n*), the blue sub-pixel row G15(*n*), the blue sub-pixel row G18(*n*), the blue sub-pixel row G21(*n*) and the blue sub-pixel row G24(*n*) respectively receive the gate driving signals in time interval t8-t9, time interval t9-t10, time interval t10-t11, time interval t11-t12, time interval t12-t13, time interval t13-t14, time interval t14-t15 and time interval t15-t16 in sequence. Therefore, the data signal D(n) can continuously provide a signal waveform (B) of the blue sub-pixel during time interval t8-t16 without switching signals. The green sub-pixel row G14(*n*), the green sub-pixel row G17(*n*), the green sub-pixel row G20(*n*) and the green sub-pixel row G23(*n*) respectively receive the gate driving signals in time interval t16-t17, time interval t17-t18, time interval t18-t19 and time interval t19-t20 in sequence. Therefore, the data signal D(n) can continuously provide a signal waveform (G) of the green sub-pixel during time interval t16-t20 without switching signals. In this regard, the red sub-pixel row G13(*n*), the red sub-pixel row G16(*n*), the red sub-pixel row G19(*n*) and the red sub-pixel row G22(*n*) respectively receive the gate driving signals in time interval t20-t21, time interval t21-t22, time interval t22-t23 and time interval t23-t24 in sequence. Therefore, the data signal D(n) can continuously provide a signal waveform (R) of the red sub-pixel during time interval t20-t24 without switching signals. That is to say, in conjunction with the driving timing result of FIG. 7B, the timing of the data signal D(n) with the same waveform (e.g., in time interval t0 to t4) may correspond to timings of one switching signal ENB1, one switching signal ENB2, one switching signal ENB3 and one switching signal ENB4, or the data signal D(n) with the same waveform in time interval t8 to t16 may correspond to timings two switching signals ENB1, two switching signals ENB2, two switching signals ENB3 and two switching signals ENB4 so as to reduce power consumption of the electronic device. Therefore, the electronic device 600 of this embodiment may also effectively reduce the number of times of the signal waveform of the data signal D(n) is switched when the pixel array 610 displays a frame (e.g., a pure color or a single color frame), and accordingly reduce power consumption of the electronic device 600.

In summary, the electronic device of the disclosure is designed with multiple switching circuits in the driving circuit to be coupled to multiple demultiplex circuits, and each of the demultiplex circuits may include multiple switching elements coupled to different sub-pixel rows. In this regard, the demultiplexer circuits of the disclosure may be grouped and located on one or more sides of the pixel array, or the demultiplexer circuits of the disclosure may be grouped to correspond to odd pixel rows or the even pixel rows of the pixel array. Further, in conjunction with the corresponding signal timing design in the electronic device of the disclosure, the switching circuits and the demultiplexer circuits may drive different sub-pixel rows according to a specific sequence. Therefore, the number of times of the signal waveform of the data signal is switched when the pixel array displays a frame (e.g., a pure color or a single color frame) may be effectively reduced, and power consumption of the electronic device may be reduced accordingly.

Although the disclosure has been described in detail with reference to the foregoing embodiments, a person of ordinary skill in the art should understand that modifications may still be made to the technical solutions in the foregoing embodiments, or equivalent replacements may be made to part or all of the technical features; and these modifications or replacements will not cause the essence of corresponding technical solutions to depart from the scope of the technical solutions in the embodiments of the disclosure.

The invention claimed is:

1. An electronic device, comprising:

a pixel array, disposed on a substrate and comprising a plurality of sub-pixel rows; and a first driving circuit, disposed on the substrate and located on one side of the pixel array, wherein the first driving circuit comprises:

a plurality of demultiplexer circuits, comprising a first demultiplexer circuit;

a plurality of switching circuits, comprising a first switching circuit, a second switching circuit, and a third switching circuit, wherein the second switching circuit is disposed between the first switching circuit and the third switching circuit, and both the first switching circuit and the third switching circuit receive the same switching signal, wherein the first switching circuit is coupled to the first demultiplexer circuit, and the first demultiplexer circuit is coupled to at least three of the plurality of sub-pixel rows, a shift register; and a plurality of output circuits, wherein one of the plurality of output circuits is connected between the shift register and two of the plurality of switching circuits.

2. The electronic device of claim 1, wherein the plurality of demultiplexer circuits comprise a second demultiplexer circuit, wherein the first switching circuit provides a first driving signal to the first demultiplexer circuit, the second switching circuit provides a second driving signal to the second demultiplexer circuit, and a timing of the first driving signal is different from a timing of the second driving signal.

3. The electronic device of claim 2, wherein the first switching circuit receives a first output signal and a first switching signal, so as to provide the first driving signal according to the first output signal and the first switching signal, and the second switching circuit receives the first output signal and a second switching signal, so as to provide the second driving signal according to the first output signal and the second switching signal, wherein a timing of the first switching signal is different from a timing of the second switching signal.

4. The electronic device of claim 3, wherein the plurality of demultiplexer circuits comprise a third demultiplexer circuit, the third switching circuit provides a third driving signal to the third demultiplexer circuit, the plurality of demultiplexer circuits comprise a fourth demultiplexer circuit, the plurality of switching circuits comprise a fourth switching circuit, and the fourth switching circuit provides a fourth driving signal to the fourth demultiplexer circuit, wherein timings of the first driving signal to the fourth driving signal are different.

5. The electronic device of claim 4, wherein the third switching circuit receives a second output signal and the first switching signal, so as to provide the third driving signal according to the second output signal and the first switching signal, and the fourth switching circuit receives the second output signal and the second switching signal, so as to provide the fourth driving signal according to the second output signal and the second switching signal, wherein timings of the first output signal and the second output signal are different.

6. The electronic device of claim 3, wherein one column of the pixel array receives a data signal, and a timing of the data signal with a same waveform corresponds to the timing of the first switching signal and the timing of the second switching signal.

7. The electronic device of claim 1, wherein the plurality of output circuits comprise a first output circuit and a second output circuit, the first output circuit outputs the first output signal to the first switching circuit and the second switching circuit according to a first clock signal, and the second output circuit outputs the second output signal to the third switching circuit and the fourth switching circuit according to a second clock signal, wherein a timing of the first output signal is different from a timing of the second output signal.

8. The electronic device of claim 1, further comprising:

a second driving circuit, disposed on the substrate, and located on another side of the pixel array, wherein the second driving circuit comprises:

a plurality of other demultiplexer circuits, wherein the pixel array further comprises a plurality of other sub-pixel rows, and each of the plurality of other demultiplexer circuits is coupled to at least three of the plurality of other sub-pixel rows; and a plurality of other switching circuits, wherein each of the plurality of other switching circuits is coupled to one of the plurality of other demultiplexer circuits.

9. The electronic device of claim 8, wherein the plurality of demultiplexer circuits are coupled to odd pixel rows of the pixel array, and the plurality of other demultiplexer circuits are coupled to even pixel rows of the pixel array.

10. The electronic device of claim 9, wherein the plurality of other demultiplexer circuits comprise another first demultiplexer circuit, and the plurality of other switching circuits comprise another first switching circuit, wherein the another first switching circuit is coupled to the another first demultiplexer circuit.

11. The electronic device of claim 10, wherein the plurality of demultiplexer circuits comprise a second demultiplexer circuit, wherein the first switching circuit provides a first driving signal to the first demultiplexer circuit, and the second switching circuit provides a second driving signal to the second demultiplexer circuit, wherein the plurality of other demultiplexer circuits comprise another second demultiplexer circuit, and the plurality of other switching circuits comprise another second switching circuit, wherein the another first switching circuit provides another first driving signal to the another first demultiplexer circuit, and the another second switching circuit provides another second driving signal to the another second demultiplexer circuit, and wherein timings of the first driving signal, the second driving signal, the another first driving signal and the another second driving signal are all different.

12. The electronic device of claim 11, wherein the first switching circuit receives a first output signal and a first switching signal, so as to provide the first driving signal according to the first output signal and the first switching signal, and the second switching circuit receives the first output signal and a second switching signal, so as to provide the second driving signal according to the first output signal and the second switching signal, wherein the another first switching circuit receives another first output signal and another first switching signal, so as to provide the another first driving signal according to the another first output signal and the another first switching signal, and the another second switching circuit receives the another first output signal and another second switching signal, so as to provide the another second driving signal according to the another first output signal and the another second switching signal, and wherein timings of the first switching signal, the second switching signal, the another first switching signal and the another second switching signal are all different.

13. The electronic device of claim 12, wherein the plurality of demultiplexer circuits comprise a third demultiplexer circuit, the third switching circuit provides a third driving signal to the third demultiplexer circuit, the plurality of demultiplexer circuits comprise a fourth demultiplexer circuit, the plurality of switching circuits comprise a fourth switching circuit, and the fourth switching circuit provides a fourth driving signal to the fourth demultiplexer circuit, wherein the plurality of other demultiplexer circuits comprise another third demultiplexer circuit, the plurality of other switching circuits comprise another third switching circuit, the another third switching circuit provides another third driving signal to the another third demultiplexer circuit, the plurality of other demultiplexer circuits comprise another fourth demultiplexer circuit, the plurality of other switching circuits comprise another fourth switching circuit, and the another fourth switching circuit provides another fourth driving signal to the another fourth demultiplexer circuit, and wherein timings of the first driving signal to the fourth driving signal and timings of the another first driving signal to the another fourth driving signal are all different.

14. The electronic device of claim 13, wherein the third switching circuit receives a second output signal and the first switching signal, so as to provide the third driving signal according to the second output signal and the first switching signal, and the fourth switching circuit receives the second output signal and the second switching signal, so as to provide the fourth driving signal according to the second output signal and the second switching signal, the another third switching circuit receives another second output signal and the another first switching signal, so as to provide the another third driving signal according to the another second output signal and the another first switching signal, and the another fourth switching circuit receives the another second output signal and the another second switching signal, so as to provide the another fourth driving signal according to the another second output signal and the another second switching signal, wherein timings of the first output signal, the second output signal, the another first output signal and the another second output signal are all different.

15. The electronic device of claim 12, wherein one column of the pixel array receives a data signal, and a timing of the data signal with a same waveform corresponds to the timings of the first switching signal, the second switching signal, the another first switching signal and the another second switching signal.

16. The electronic device of claim 8, wherein the second driving circuit further comprises:

another shift register; and a plurality of other output circuits, coupled to the another shift register, wherein each of the plurality of other output circuits is coupled to two of the plurality of other switching circuits.

17. The electronic device of claim 16, wherein the plurality of other output circuits comprise another first output circuit and another second output circuit, the another first output circuit outputs the another first output signal to the another first switching circuit and the another second switching circuit according to another first clock signal, and the another second output circuit outputs the another second output signal to the another third switching circuit and the another fourth switching circuit according to another second clock signal, wherein a timing of the another first output signal is different from a timing of the another second output signal.

* * * * *